United States Patent [19]

Kinaga et al.

[11] Patent Number: 4,713,862

[45] **Date of Patent: * Dec. 22, 1987**

[54] SIDE DOOR HINGE MECHANISM IN MOTOR VEHICLE

[75] Inventors: Eiichi Kinaga, Toyota; Daiichi Shiraishi, Seto, both of Japan

[73] Assignee: Toyota Jidosha Kabushiki Kaisha, Aichi, Japan

[ * ] Notice: The portion of the term of this patent subsequent to May 19, 2004 has been disclaimed.

[21] Appl. No.: 793,246

[22] Filed: Oct. 31, 1985

[30] Foreign Application Priority Data

| | | | |
|---|---|---|---|
| Nov. 2, 1984 | [JP] | Japan | 59-231679 |
| Nov. 2, 1984 | [JP] | Japan | 59-167005[U] |
| Nov. 2, 1984 | [JP] | Japan | 59-167006[U] |
| Nov. 2, 1984 | [JP] | Japan | 59-167009[U] |
| Nov. 2, 1984 | [JP] | Japan | 59-167011[U] |

[51] Int. Cl.[4] ..... E05D 15/32

[52] U.S. Cl. ..... 16/223; 16/370; 296/146

[58] Field of Search ..... 16/370, 371, 366, 368, 16/282, 288, 294, 302, 308, 319, 386, 223; 296/146, 202, 49/381, 398

[56] References Cited

U.S. PATENT DOCUMENTS

| | | | |
|---|---|---|---|
| 2,008,256 | 7/1935 | Leferre | 16/370 |
| 3,206,186 | 9/1965 | Thomas | 16/370 X |
| 3,339,226 | 9/1967 | Brown . | |
| 3,427,682 | 2/1969 | Bachman . | |
| 3,758,990 | 8/1973 | Balanos . | |
| 3,889,316 | 6/1975 | Kioke . | |
| 3,969,789 | 7/1976 | Wize | 16/334 |
| 4,116,514 | 9/1978 | Laurence | 16/223 X |
| 4,474,402 | 10/1984 | Shelton . | |
| 4,502,182 | 3/1985 | Lautenschlager et al. . | |

FOREIGN PATENT DOCUMENTS

| | | | |
|---|---|---|---|
| 126438 | 11/1984 | European Pat. Off. . | |
| 135114 | 3/1985 | European Pat. Off. . | |
| 135929 | 4/1985 | European Pat. Off. . | |
| 136714 | 4/1985 | European Pat. Off. . | |
| 140245 | 5/1985 | European Pat. Off. . | |
| 1075958 | 2/1960 | Fed. Rep. of Germany . | |
| 3223938 | 12/1983 | Fed. Rep. of Germany . | |
| 1285896 | 1/1962 | France . | |
| 2542796 | 9/1984 | France | 296/202 |
| 55-101263 | 1/1954 | Japan . | |
| 57-46014 | 7/1981 | Japan . | |
| 58-36767 | 8/1983 | Japan . | |
| 60-31474 | 3/1985 | Japan . | |
| 60-64122 | 5/1985 | Japan . | |
| 447734 | 5/1936 | United Kingdom . | |
| 462033 | 3/1937 | United Kingdom . | |

OTHER PUBLICATIONS

European Search Report, Dec. 9, 1985, Publication No. 0,140,245.

*Primary Examiner*—Fred Silverberg
*Attorney, Agent, or Firm*—Parkhurst & Oliff

[57] ABSTRACT

A quadric rotary link device for a side door hinge mechanism in a motor vehicle is disclosed. The device has first and second arms connected by rotary center shafts to a vehicle body and a side door. The hinge mechanism has a door side base and a body side base formed long in the vertical direction. The door side base is secured to the rocking proximal end of the side door. The body side base is secured to a vertical surface of the vehicle body. There are four top rotary center shafts and four bottom rotary center shafts supported at two pairs of positions in the top and bottom of the door side base and the body side base, respectively.

6 Claims, 19 Drawing Figures

SIDE DOOR HINGE MECHANISM IN MOTOR VEHICLE

BACKGROUND OF THE INVENTION

1. Field of the Invention

This invention relates to improvements in a side door hinge mechanism in a motor vehicle through the utilization of a quadric rotary link mechanism.

2. Description of the Related Art

In most cases, the side door in a motor vehicle, e.g. passenger car has heretofore been installed in a manner to be rotatable about a hinge affixed to a vehicle body for opening or closing. In order to allow an occupant of the motor vehicle to open or close the side door for getting in and out of the motor vehicle, a door opening angle commensurate to the total length of the side door is required. At this time, when a space outwardly of the motor vehicle is small, there are many cases where it is difficult for the occupant to get in and out of the vehicle because the side door cannot be opened sufficiently.

In contrast thereto, as disclosed in Japanese Utility Model Laid-Open (Kokai) No. 46014/1982 or 101263/1980 for example, here has been proposed a side door hinge mechanism through the utilization of a quadric rotary link mechanism, wherein the quadric rotary link mechanism comprises: a rotary link interconnecting a point on a body of the vehicle and another point on a side door as rotary centers out of two points spaced apart from each other on the body and two points spaced apart from each other on the side door; another rotary link interconnecting the other point on the body and the other point on the side door as being centers; a portion between the two rotary centers on the body; and another portion between the two rotary centers on the side door.

The side door hinge mechanism utilizing the above-described quadric rotary link mechanism makes it possible for the occupant to reduce the necessary space outwardly of the motor vehicle while securing a space at his feet. In consequence, even when the space outwardly of the motor vehicle is small, the occupant can get in and out of the motor vehicle by opening or closing the side door.

In the side door hinge mechanism utilizing the above-described quadric rotary link mechanism, the rotary center shaft of the side door is spaced apart a rotary link's length from the rotary center shaft of the body, whereby a moment acting on the side door hinge due to a load of the side door becomes high and also a high load due to this moment is applied to a portion for mounting the rotary center shaft of the side door.

In consequence, in order to increase the rigidity for supporting the side door, it is necessary to mount a plurality of door hinges arranged in the vertical direction.

However, when the plurality of side door hinges are mounted in the vertical direction as described above, such disadvantages are presented that these rotary center shafts should be aligned with each in the vertical direction and the works of mounting and adjusting are troublesome.

Further, the rigidity of the surfaces of the body and the side door, to which the above-described rotary center shafts, particularly, the rigidity of the surface of the side door should be made considerably high. To satisfy this requirement, such a disadvantage is presented that the weights of the side door and of the door hinge should be increased.

More specifically, if the rigidity of the side door is low, then, in conjunction with the long length of the door hinge, i.e. the rotary link, for example the rigidity in the vertical direction, torsional rigidity and rigidity for bearing an excessive opening of the side door when the side door is opened become low, such disadvantages are presented that the side door is displaced downwardly, distorted or deformed when fully opened.

Further, if the rigidity is low when the door is closed, such a disadvantage is presented that the ill-fitting to the body occurs.

Here, in the side door hinge mechanism of the type described, in order to improve accuracies of the rotary center shafts of the arms constituting the quadric rotary link devices, such an arrangement may be adopted that these rotary center shafts are supported on a body side base and a door side base, each of which is formed into a vertically long plate shape, and these body side base and door side base are tightened and fixed to the vehicle body and the side door through bolts.

Such disadvantages are presented that, when the body side base and the door side base, which are long members, are closely tightened and fixed at the whole surfaces thereof opposed to the vehicle body and the side door to the vehicle body and the side door, if the motor vehicle being previously assembled thereto with the side door hinge mechanism is passed through a coating process, then the spaces, to which the coating cannot be applied between the body side base and the vehicle body and between the door side base and the side door, occur in fairly large areas, and moreover, in a coating drying furnace, the body side base is closely attached to the door side base, whereby heat increase in the closely attached surfaces is hindered, so that insufficiently dried portions may occur.

Provided, normally, between the vehicle body and the side door is a power source for the power window regulator or a wire harness for a control system, for example, of the side door.

For the side door mounted through the above-described side door hinge mechanism, the wire harness is provided, passing through a space formed in the vertical direction between the top and bottom quadric rotary link devices.

In this case, differing from the case of using an ordinary hinge, the side door is greatly moved in the longitudinal direction and in the widthwise direction of the vehicle body during its opening or closing, whereby the wire harness must be elongated as commensurate to this between the side door and the vehicle body.

When the wire harness is made elongate as described above, there is a possibility that the wire harness is bitten in between the arms and the door side base or the body side base, or between the arms during opening or closing of the side door.

When the main arm is formed integrally in the vertical direction in order to increase the rigidity of the side door hinge mechanism, it is necessary to provide a space in the intermediate portion in the vertical direction of the main arm and the wire harness is passed through this space, so that the main arm may not interfere with the wire harness.

Even when the main arm is formed therein with the space for allowing the wire harness to pass therethrough as described above, the wire harness is formed elongated between the side door and the vehicle body as aforesaid, whereby there is presented such disadvantages that the main arm comes into contact with the wire harness to make the coating of the main arm peeled off, and the wire harness itself is worn.

SUMMARY OF THE INVENTION

It is therefore the primary object of the present invention to provide a side door hinge mechanism in a motor vehicle, wherein the works of mounting and adjusting are easy and a rigidity sufficient for supporting the side door is provided without increasing the weight of the side door to a considerable extent.

Further object of the present invention is to provide a side door hinge mechanism in a motor vehicle wherein inaccuracy in the coaxial degree is low after assembling, with no need for the work of adjusting of the coaxial degree between the top and the bottom rotary center shafts.

A further object of the present invention is to provide a side door hinge mechanism in a motor vehicle, wherein the areas where coating cannot be applied are minimized during the coating process and heat increase in the vehicle body and the side door is not hindered.

A further object of the present invention is to provide a side door hinge mechanism in a motor vehicle, wherein a pair of top and bottom quadric rotary link devices are secured to a door side base and a body side base, and, even when a wire harness is provided between the side of the vehicle body and the side of the side door, the wire harness can avoid being bitten in between the arms constituting the quadric rotary link devices or between the arms and the door side base or the body side base.

A further object of the present invention is to provide a side door hinge mechanism in a motor vehicle, wherein arms disposed inwardly in the widthwise direction of the vehicle body in a pair of top and bottom quadric rotary link devices are formed integrally in the vertical direction, a space for allowing a wire harness is provided between the vehicle body and the side door, the wire harness and the main arm are prevented from directly contacting each other, so that the peel-off of coating of the main arm and the wear of the wire harness due to such contacts as described above can be avoided.

To this end, the present invention contemplates that a side door hinge mechanism in a motor vehicle, wherein a quadric rotary link device comprises:

a first arm interconnecting one point on the side of a vehicle body and one point on the side of a side door as rotary center shafts out of four points including two points disposed on the side of the vehicle body and spaced apart from each other and two points disposed on the side of the side door and spaced apart from each other;

a second arm interconnecting the other point on the side of the vehicle body and the other point on the side of the side door as rotary center shafts out of the above-described four points;

a portion between said two points on the side of the vehicle body; and a portion between said two points on the side of the side door; wherein said hinge mechanism is provided therein with a door side base formed long in the vertical direction along an end portion on the side of a rocking proximal end of said side door and secured to said end portion and a body side base formed long in the vertical direction along a surface being adjacent to said end portion on the side of the vehicle body and secured to said surface; and said rotary center shafts are consisted of four rotary top center shafts and four bottom roatay center shafts aligned with said top rotary center shafts and positioned downwardly thereof, said top rotary center shafts and said bottom rotary center shafts being supported at two pairs of positions in the top portions and the bottom portions of said door side base and said body side base, respectively.

To the above end, the present invention contemplates that one of said first arm and second arm consists of a top control arm rotatably connected at opposite ends thereof to said rotary center shafts on one side of said body side base and said door side base out of said top rotary center shafts and a bottom control arm rotatably connected at opposite ends thereof to said bottom rotary center shafts aligned with said top rotary center shafts at the opposite end of said top control arm; and other of said first arm and second arm is consisted of a main arm formed integrally in the vertical direction and rotatably connected at opposite ends thereof in the vertical and widthwise directions thereof to said top and bottom rotary center shafts on the other side.

To the above end, the present invention contemplates that said first arm is consisted of a first top control arm rotatably connected at opposite ends thereof to said roatry center shafts on one side of said body side base and said door side base out of said top rotary center shafts and a first bottom control arm rotatably connected at opposite ends thereof to said bottom rotary center shafts aligned with said top rotary center shafts at the opposite end of said first top control arm; and said second arm is consisted of a second top arm rotatably connected at opposite ends thereof to the top rotary center shafts on the other side, and a second bottom arm rotatably connected at opposite ends thereof to the bottom rotary center shafts on the other side.

To the above end, the present invention contemplates that surfaces opposed to the surfaces of said side door and said vehicle body of said door side base and said body side base have float-up surfaces not contacting the surfaces of said side door and said vehicle body, which are portions other than the surfaces mounted to said side door and the vehicle body of said door side base and said body side base.

To the above end, the present invention contemplates that said mounted surfaces are portion close to the circumferences of bolt holes for connecting said door side base and said body side base to the surfaces of the said door and the vehicle body.

To the above end, the present invention contemplates that a wire harness extends from said end portion of the side door, to which said door side base is secured, to the surface of the vehicle body, to which said body side base is secured, passing through a space in the vertical direction between said top and bottom rotary center shafts, a harness clamp bracket integrally projected between said top and bottom rotary center shafts, and a resin clamp fixes the intermediate portion of said wire harness to said harness clamp bracket.

To the above end, the present invention contemplates that said main arm is formed integrally in the vertical direction, rotatably connected at upper opposite ends thereof to the top rotary center shafts disposed inwardly in the widthwise direction of the vehicle body, on the sides of the vehicle body and the side door, respectively, and rotatably supported at lower opposite ends thereof by the bottom rotary center shafts disposed inwardly in the widthwise direction of the vehicle body, which are opposed to said top rotary center shafts, said top control arm is rotatably supported at opposite ends thereof by the remaining top rotary center shafts, and said bottom control arm is rotatably supported at opposite ends thereof by the remaining bottom rotary center shafts;

said mechanism is provided therein with a wire harness extending from said end portion, to which said door side base is secured, to the surface of the vehicle body, to which said body side base is secured, passing by the neiborhood of the rotary center shafts of said main arm on the side of the vehicle body between the top and bottom rotary center shafts in the vertical direction;

said main arm is formed with a pipe portion supported at top and bottom ends thereof by the top and bottom rotary center shafts on the side of the vehicle body and a space adjacent to the intermediate portion in the vertical direction of said pipe portion for allowing a wire harness to pass therethrough; and a harness protector made of resin is mounted to said pipe portion facing said space.

To the above end, the present invention contemplates that said main arm comprises said pipe portion and a top and a bottom arms integrally projecting sideways from the top portion and the bottom portion of said pipe portion, said top arm and said bottom arm being of generally triangular shapes tapered toward the forwards ends thereof and rotatably supported at the forward ends thereof by the top and bottom rotary center shafts on the side of the door; and said space is formed between the proximal ends of the top arm and the bottom arm, connected to said pipe portion.

To the above end, the present invention contemplates that said harness protector is a tubular member which can be resiliently flared by a slit longitudinally formed in the axial direction, and said pipe portion is formed thereon with projections coupled to said slit, for locking rotation of said harness protector.

In this invention, the rotary center shafts in the top and the bottom four link door hinge are supported on the door side base secured to the side of the side door and on the body side base secured to the side of the vehicle body, respectively, whereby a door hinge mechanism is formed integrally and long in the vertical direction and the coaxial degree is obtained in the state of a single product, thus making the assembling and the adjusting easy and controlling inaccuracy in the coaxial degree in the state mounted to the side door and the vehicle body.

According to the present invention, the rotary shafts in the top and bottom quadric link door hinges are supported by the door side base secured to the side door and by the body side base secured to the body, respectively, whereby a door hinge mechanism formed integrally and long in the vertical direction is formed, so that the works of assembling and adjusting become easy and the rigidity of the hinge itself is increased and the rigidity of assembling in the state mounted to the side door and the body is increased.

According to the present invention, the portions other than the surfaces to be secured to the side door and the vehicle body of the door side base and the body side base are floated up, whereby, in the mounted state, the mounted surfaces on the side of the side door and the surfaces on the side of the vehicle body are formed into non-contact float-up surfaces, during the coating process the coating material enters the portions of float-up surfaces and, in the coating drying furnace, heat increase in the portions of float-up surfaces of the vehicle body and the side door may not be hindered.

According to the present invention, the wire harness is held by the harness clamp bracket projected from the side of the body side base through the resin clamp at the intermediate position between the top and bottom quadric rotary link devices and between the vehicle body's side and the side door's side, whereby the wire harness can avoid being bitten in between the arms of the link devices, the arms and the door side base of the body side base.

According to the present invention, the wire harness comes into contact with the main arm through the harness protector made of resin, so that the peel-off and wear of the coating of the main arm and the wear of the wire harness can be avoided.

DETAILED DESCRIPTION OF THE PREFERRED EMBODIMENT

Figure 1:
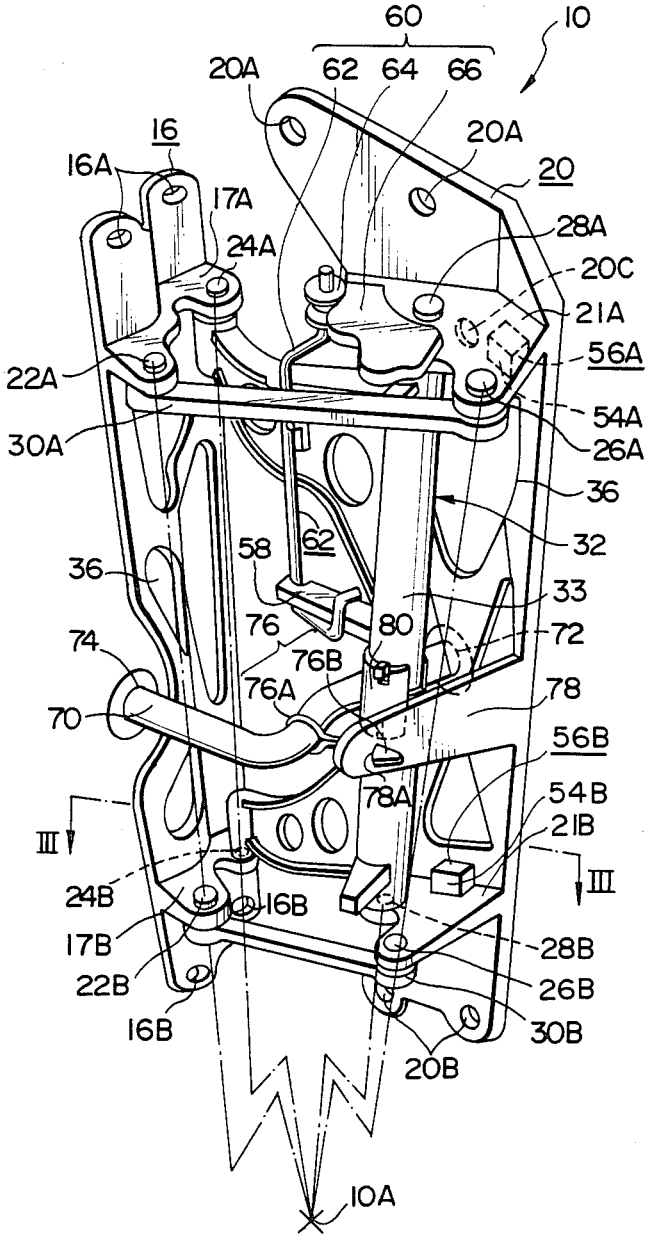
FIG. 1 is a perspective veiw showing one embodiment of the side door hinge mechanism in a motor vehicle according to the present invention.

Description will hereunder be given of one embodiment of the present invention with reference to the drawings.

As shown in FIGS. 1 to 4, in this embodiment, a side door hinge 10 in a motor vehicle, comprises:

a door side base 16 formed long in the vertical direction along an end panel 14 as being an end portion on the side of a rocking proximal end of a side door 12 of a motor vehicle (not shown generally) and secured to the end panel 14;

a body side base 20 formed long in the vertical direction along a surface 18A of a front pillar 18 on the body adjacent the end panel 14 and secured to the surface 18A;

four top rotary center shafts 22A, 24A, 26A and 28A and four bottom rotary center shafts 22B, 24B, 26B and 28B aligned with the top rotary center shafts 22A, 24A, 26A and 28A and positioned downwardly thereof, the top center shafts and the bottom center shafts being supported at least at two pairs of positions in the top portions and the bottom portions of the door side base 16 and the body side base 20;

a top control arm 30A rotatably connected at opposite ends thereof to the top rotary center shafts 22A and 26A on the outer side in the vehicle widthwise direction of the door side base 16 and the body side base 20 out of the top rotary center shafts 22A, 24A, 26A and 28A;

a bottom control arm 30B rotatably connected at opposite ends thereof to the bottom rotary center shafts 22B and 26B which are aligned with the top rotary center shafts 22A and 26B at the opposite ends of the top control arm 30A; and a main arm 32 formed integrally in the vertical direction and rotatably connected at opposite ends in the vertical and widthwise directions thereof to the top rotary center shafts 24A and 28A and the bottom rotary center shafts 24B and 28B on the other side.

Figure 2:
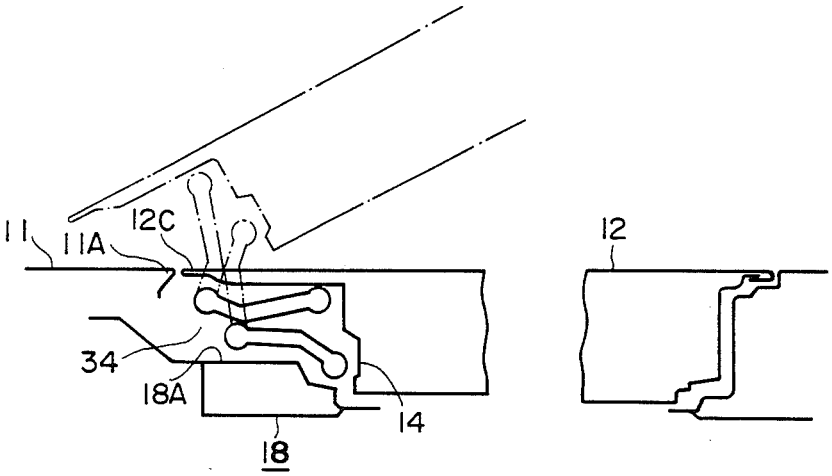
FIG. 2 is a schematic sectional view showing the positional relationship between the front pillar and the side door, to the both of which is secured the side door hinge according to the above embodiment.
Figure 3:
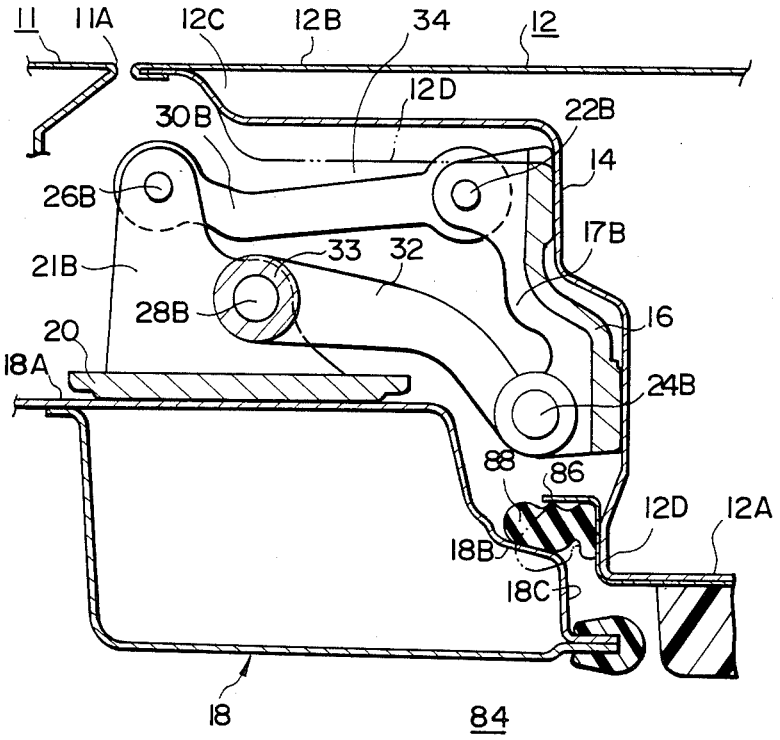
FIG. 3 is a sectional view enlargedly showing the essential portions of FIG. 2.

Here, as shown in FIGS. 2 and 3, an inner panel 12A and an outer panel 12B in the side door 12 are extended along the outer surface of the side door 12, further forwardly from the end panel 14, to thereby form an extension 12C. This extension 12C is extended forwardly within a scope not interfering with a front side fender 11 when the door is opened. The forward end of the extension 12C in the longitudinal direction of the vehicle body is disposed outwardly of the top rotary center shaft 26A located at the foremost position, and positioned close to the forward end of the front pillar 18, whereby a space 34 for receiving the side door hinge 10 is formed between the outer surface 18A of the front pillar 18 and the extension 12.

Furthermore, the extension 12C is formed into a thick width portion 12D expanded inwardly in the direction of the door thickness at a position in the vertical direction between the top control arm 30A and the bottom control arm 30B, which are disposed outwardly in the widthwise direction of the vehicle body.

The portion of the extension 12C at the position outwardly of the top and bottom control arms 30A and 30B is formed into a thin plate shape so as not to interfere with these control arms.

The main arm 32 is disposed inwardly of the top control arm 30A and the bottom control arm 30B in the widthwise direction of the vehicle body, and, in plan view, is disposed in a manner to be outwardly convexed and along the rear outer side angle portion and the surface 18A of the front pillar 18 when the side door 12 is closed.

In other words, when the side door 12 is fully closed, the main arm 32 disposed inwardly in the widthwise direction of the vehicle body can be housed without interfering with the front pillar 18, and yet, being disposed as close as possible to the front pillar 18.

On the other hand, the top control arm 30A and the bottom control arm 30B, both of which are disposed outwardly of the main arm 32 in the widthwise direction of the vehicle body, are bent in a manner to be slightly convexed inwardly in the widthwise direction of the vehicle body, so that the both control arms 30A, 30B can avoid interfering with a rear end portion 11A of the front side fender 11 when the side door 12 is fully opened and the side door 12 when fully opened can slide as forwardly from the vehicle body as possible.

The door side base 16 is formed into a generally crank-shape in horizontal section, following the form of the end panel 14 of the side door 12. The door side base 16 is tightened and fixed to the end panel 14 through bolts, not shown, penetrating through bolt holes 16A and 16B which are formed at two positions at the top end portion and at two positions at the bottom end portion thereof.

The top rotary center shafts 22A and 24A are generally vertically secured to and supported by a bearing supporting portion 17A horizontally extended from a position close to and downwardly shifted from the top bolt holes 16A of the door side base 16.

The bottom rotary center shafts 22B and 24B are generally vertically supported by a bearing supporting portion 17B horizontally extended from a position close to and upwardly shifted from the bottom bolt holes 16B of the door side base 16.

The body side base 20 is formed with two bolt holes 20A at the top portion thereof, two bolt holes 20B at the bottom portion thereof and a bolt hole 20C close to and downwardly of the top bolt holes 20A. The body side base 20 is tightened and fixed to the surface 18A disposed outwardly of the front pillar 18 in the widthwise direction of the vehicle body through bolts, not shown, inserted through the bolt holes 20A, 20B and 20C.

Here, the upper half portion of the body side base 20 is bent to have an obtuse angle in its horizontal section, so that the rigidity in section can be increased.

The top rotary center shafts 26A and 28A are generally vertically supported by a bearing supporting portion 21A horizontally extended from a position disposed upwardly of the bolt hole 20C of the body side base 20 and close to an shifted downwardly from the top bolt holes 20A of the body side base 20.

Formed at a position close to and upwardly shifted from the bottom bolt holes 20B of the body side base 20 is a bearing supporting portion 21B horizontally extended, and this bearing supporting portion 21B is adapted to generally vertically support the bottom rotary center shafts 26B and 28B.

Relative to the top rotary center shafts 22A, 24A, 26A and 28A, the bottom rotary center shafts 22B, 24B, 26B and 28B are aligned on inclined axes slightly inclined from the vertical axis, so that the bottom center shafts can intersect the top center shafts at a hypothetical point 10A disposed downwardly of the side hinge 10.

Designated at 36 show lightening holes formed to lighten the weights in the door side base 16 and the body side base 20, respectively.

The top and bottom control arms 30A and 30B, being small in diameter, mainly bear the excessively opening load of the side door 12 and the torsional load, prevent the side door 12 from being distorted due to a gravitational moment and an excessive load of the side door 12, and further, control the rockering locus of the side door 12, whereas, the main arm 32 mainly support the weight of the side door 12.

Figure 4:
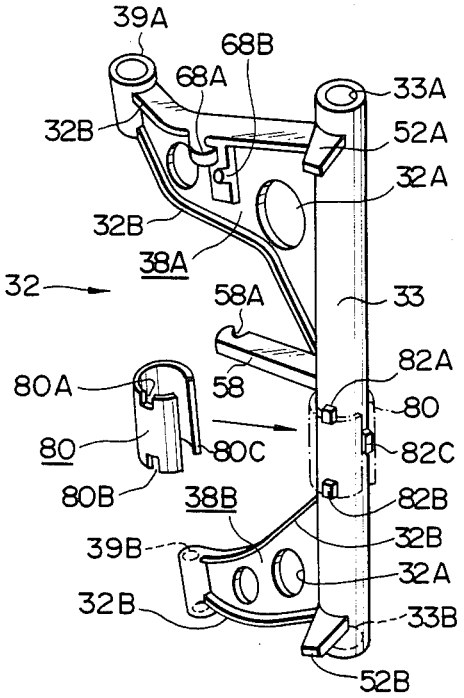
FIG. 4 is a disassembled perspective view showing the main arm and the harness protector in the above embodiment.

As shown in FIG. 4, the main arm 32 is formed into a generally K-shape. A vertical side portion of the K-shape is formed to provided a large-diameter pipe portion 33 which is coupled at a top coupling hole 33A thereof onto the top rotary center shaft 28A on the body's side, and further, coupled at a bottom coupling hole 33B threrof onto the bottom rotary center shaft 28B on the body's side. A top side portion of the K-shape is formed to provide a generally triangular top arm 38A having a horizontal upper side edge and an inclined lower side edge, a coupling hole 39A at the forward end of which is coupled onto the top rotary center shaft 24A on the door side base 16. A bottom side portion of the K-shape is formed to provide a generally triangular bottom arm 38B having an inclined upper side edge and a horizontal lower side edge, a coupling hole 39B at the forward end of which is coupled onto the bottom rotary shaft 24B on the door side base 16. A vertical space is formed between the portions of the top arm 38A and of the bottom arm 38B to the pipe portion 33. The top arm 38A, being longer than the bottom arm 38B in the vertical direction, i.e. larger than the bottom arm 38B in the longitudinal section, mainly bears the load of the side door 12.

Designated at 32A are lightening holes formed to lighten the weights in the top arm 38A and the bottom arm 38B, and 32B reinforcing ribs formed along the upper end edge and the lower end edge of the top arm 38A and the bottom arm 38B in a manner to project in the widthwise directions of the plates.

Figure 5:
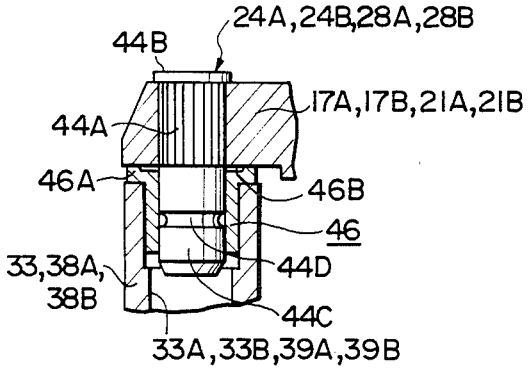
FIG. 5 is a sectional view showing the mounted state of the rotary center shaft of the main arm in the above embodiment.

As shown in FIG. 5, the top rotary center shafts 24A, 28A and the bottom rotary center shafts 24B, 28B for supporting the main arm 32 are cantilever pins each including a serrated shafts 44A inserted from above or below into each of the bearing supporting portions 17A, 21A, 17B and 21B which are opposed to the top and bottom rotary center shafts, a collar 44B and an insertion portion 44C.

Figure 6:
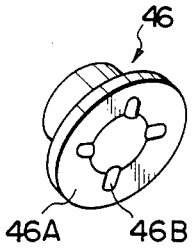
FIG. 6 is a perspective view showing the bush coupled to the rotary center shaft shown in FIG. 5.

Press-fitted into each of the coupling holes 33A, 33B, 39A and 39B is a bush 46 having a collar 46A and being inseted from the outer end of the coupling holes (Refer to FIG. 6). Inserted through this bush 46 is the insertion portion 44C at the forward end of the cantilever-shaped top rotary center shafts 24A, 28A or bottom rotary center shafts 24B, 28B.

The insertion portion 44C inserted into the bush 46 of each of the top rotary center shafts 24A, 28A and the bottom rotary center shafts 24B, 28B is formed with an oil groove 44D in the circumferential direction thereof, and lubricating oil is filled in the oil groove 44D.

A portion on the outer end face of the collar 46A of the bush 46, being contiguous to the outer periphery of the insertion portion 44C, is formed with four oil grooves 46B in the radial directions and at equal angular intervals in the circumferential direction (Refer to FIG. 6).

Figure 7:
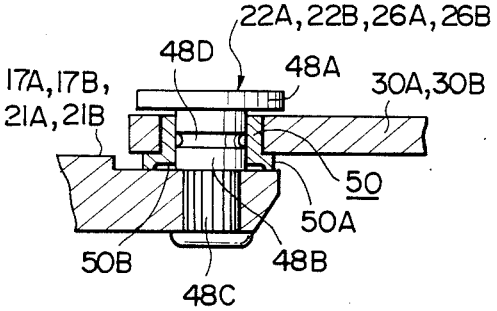
FIG. 7 is a sectional view showing the mounted state of the rotary center shaft on the side of the control arm in the above embodiment.

As shown in FIG. 7, the top rotary center shafts 22A, 26A and the bottom rotary center shafts 22B, 26B for supporting the top control arm 30A and the bottom control arm 30B are cantilever pins each including a collar 48A, an insertion portion 48B and a serrated shaft 48C.

A bush 50 having a collar 50A is press-fitted into each of opposite ends of the top control arm 30A and the bottom control arm 30B from the sides of the bearing supporting portion 17A, 21A, 17B or 21B.

The top rotary center shafts 22A, 26A and the bottom rotary center shafts 22B, 26B are each inserted at the insertion portion 48B thereof into the bush 50, the serrated shaft 48C thereof is press-fitted into each of the bearing supporting portions 17A, 21A, 17B and 21B, which is clinched by the forward end of the serrated shaft 48C and affixed.

The outer periphery of the insertion portion 48B is formed with an oil groove 48D in the circumferential direction, the outer end face of the collar 50A of the bush 50 is formed with four oil grooves 50B in the radial directions from the inner periphery, and lubricating oil is filled in all of these oil grooves 50B.

Formed at the top end portion and the bottom end portion of the pipe portion 33 of the main arm 32 are stoppers 52A and 52B which project horizontally.

Provided on the body side base 20 in opposed relationship to these stoppers 52A and 52B are protrusions 56A and 56B which are formed with stopper surfaces 54A and 54B, respectively, for abutting against the stoppers 52A and 52B at the time of full opening of the side door 12 to regulate the fully opened position of the side door 12.

The protrusion 56A protrudes at a corner portion between the bottom face of the bearing supporting portion 21A and the inner surface of the body side base 20, and the protrusion 56B protrudes at a corner portion between the top face of the bearing supporting portion 21B and the inner surfce of the body side base 20.

A door check mechanism 60 is formed between a torsion bar hook 58 horizontally projection from a generally central position in the vertical direction of the pipe portion 33 of the main arm 32 and the bearing supporting portion 21A of the body side base 20.

This door check mechanism 60 is constituted by a torsion bar 62, a roller 64 and a cam plate 66.

Figure 8:
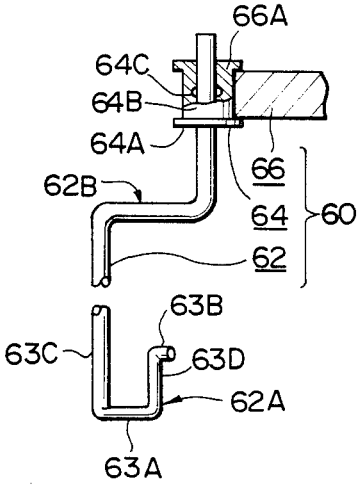
FIG. 8 is a sectional view showing the essential portions of the door check mechanism in the above embodiment.
Figure 9:
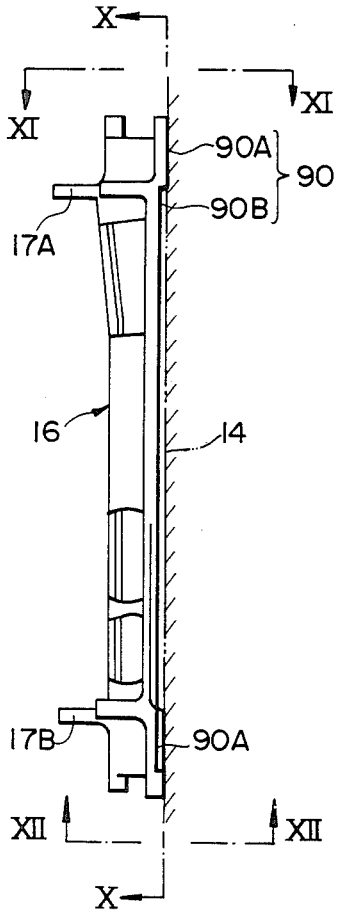
FIG. 9 is a side view showing the mounted state of the door side arm in the above embodiment.
Figure 10:
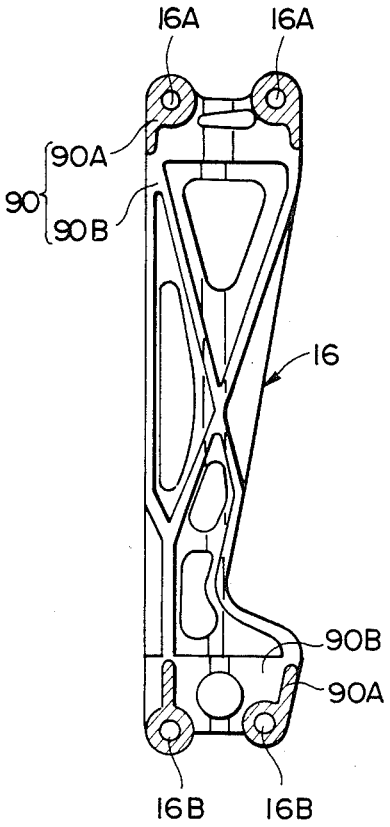
FIGS. 10 to 12 are views in the directions indicated by the arrows from lines X—X to XII—XII in FIG. 9.

As shown in FIGS. 1 and 8, the torsion bar 62 is provided at the bottom end thereof with a generally U-shaped wind-in form portion 62A, the forward end of which is bent at a right angle, and the torsion bar hook 58 of the pipe portion 33 is clamped by two axes including a bottom side 63A of the U-shape and the rectangularly bent portion 63B from above and below so as to position the torsion bar hook 58 in its axial direction. Furthermore, the torsion bar hook 58 is clamped by two axis portions 63C and 63D in the lateral direction so as to position the torsion bar hook 58 in the rotating direction.

The top end portion of the torsion bar 62 is formed into a crank-shaped portion 62B and the roller 64 is rotatably and axially slidably coupled onto the crank-shaped portion 62B from above.

In FIG. 4, designated at 58A is a recess for positioning the rotating direction of the torsion bar 62, being formed in the torsion bar hook 58, and 68A and 68B positioning projections formed on the top arm 38A of the main arm 32, for clamping therebetween the torsion bar 32.

The cam plate 66 is a flat plate-shaped member secured to a portion of the top surface of the bearing supporting portion 21A, which is opposed to the door side base 16, and a cam surface 66A of the cam plate 66 in parallel to the center axis of the pipe portion 33.

The lift of the cam surface 66A from the center axis of the pipe portion 33 is varied such that the feeling of click motion is produced at suitable positions on the cam surface 66A when the side door 12 is opened or closed.

As shown in FIG. 8, the roller 64 is resiliently urged by the torsion bar 62 against the cam surface 66A of the cam plate 66 to be brought into line-to-line contact therewith all the time.

Further, the roller 64 is provided at the top and bottom portions thereof with collars 64A which clamp therebetween the cam plate 66 from above and below to being the cam plate 66 into rotating contact therewith, so that the cam plate 66 can be positioned in the vertical direction.

A circumferential grease groove 64C is formed on the inner periphery of a rotatable contacting portion 64B formed between the collars 64A of the roller 64, and heat-resistant grease is filled in the grease groove 64C, so that the durability of the roller 64 can be increased.

A wire harness 70 of the door, for an electrically driven window regulator and the like, not shown, of the side door 12, is extended in a generally S-shape from a harness hole 72 fromed on the front pillar 18, being diverted downwardly, to a harness hole 74 formed on the end panel 14 of the side door 12.

Here, the wire harness 70 extends along the side surface of the pipe portion 33 of the main arm 32, which is opposed to the side door 12, and further, passes through a V-shaped portion defined by the top and the bottom control arms 30A and 30B of the main arm 32.

The wire harness 70 is fixed to a harness clamp bracket 78 projecting from the body side base 20 through a harness clamp 76 at a position close to the pipe portion 33. The harness clamp 76 is made of resin, holds the wire harness 20 with the ring-shaped portion 76A and is inserted and fixed into a mounting hole 78A formed at the forward end position of the harness clamp bracket 78 with its forward end portion 76B.

A harness protector 80 made of resin is mounted at a position where the pipe portion 33 of the main arm 32 is adjacent to the wire harness 70, i.e. in a space in the vertical direction between connecting portions of the top arm 38A and of the bottom arm 38B to the pipe portion 33, so that peel-off of a coating on the pipe portion 33 due to the contact of the wire harness 70 with the pipe portion 33 can be avoided.

As shown in FIG. 4, the harness protector 80 is a generally cylindrical member capable of flaring by a slit 80C vertically sectioning the harness protector 80, and formed at the top end and the bottom end with cutouts 80A and 80B, respectively.

On the other hand, the pipe portion 33 is provided at positions opposed to the cutouts 80A, 80B of the harness protector 80 and the slit 80C with projections 82A, 82B and 82C, whereby, when the harness protector 80 is resiliently coupled onto the pipe portion 33A, the cutouts 80A, 80B and the slit 80C are engaged with these projections 82A–82C, so that the harness protector 80 can be positioned.

Here, as shown in FIG. 3, the corner portion at the forward end of the inner panel 12A of the side door 12 on the inboard side projects forwardly from the rear end surface of the door side base 16 on the side of a compartment 84 at a position inside the end panel 14 in the widthwise diretion of the vehicle body, i.e. at a position inwardly of the side door hinge 10 in the widthwise direction of the vehicle body and forms a generally L-shaped weather strip mount 86 at a projecting portion 12D.

A door weather strip 88 is secured to this weather strip mount 86.

On the other hand, a weather strip contacting surface 18B of the front pillar 18, opposed to the door weather strip 88 is formed at a position shifted from the surface 18A toward the compartment 84, whereby the weather strip contacting surface 18B comes into contact with the surface of the door weather strip 88 on the side of the compartment 84 when the side door 12 is fully closed.

In this case, the longitudinal position of the corner portion of the weather strip contacting surface 18B, i.e. the rear end face 18C of the front pillar 18 is shifted forwardly as compared with the normal case corresponding with the longitudinal position of the weather strip mount 86.

The door side base 16 and the body side base 20 are tightened and fixed to the end panel 14 of the side door 12 and the surface 18A of the front pillar 18 through bolts, respectively. A surface 90 of the door side base 16, opposed to the end panel 14 is constituted by mounting surfaces 90A being brought into contact with the end panel 14 and float-up surfaces 90B being not in contact with the end panel 14.

As shown in FIGS. 9 to 12, the mounting surfaces 90A extend only around the top and bottom bolt holes 16A and 16B, and other portion are formed into the float-up surfaces 90B.

Furthermore, as shown in FIGS. 13 to 16, a surface 92 of the body side base 20, opposed to the surface 18A of the front pillar 18 is constituted by mounting surfaces 92A contacting the surface 18A and float-up surfaces 92B not contacting thereto.

Figure 11:
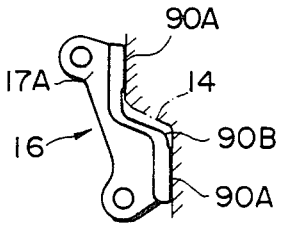
Figure 12:
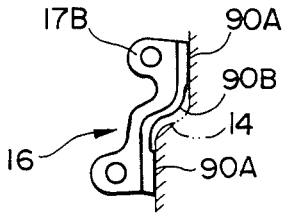
Figure 14:
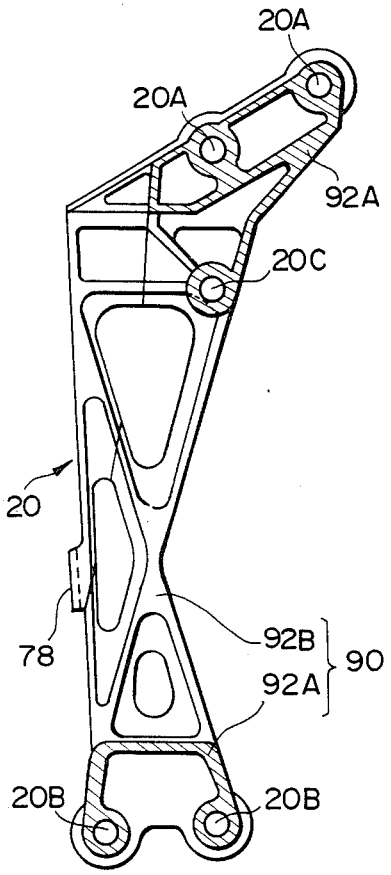
FIGS. 14 to 16 are views in the directions indicated by the arrows from lines XIV—XIV to XVI—XVI in FIG. 13.
Figure 13:
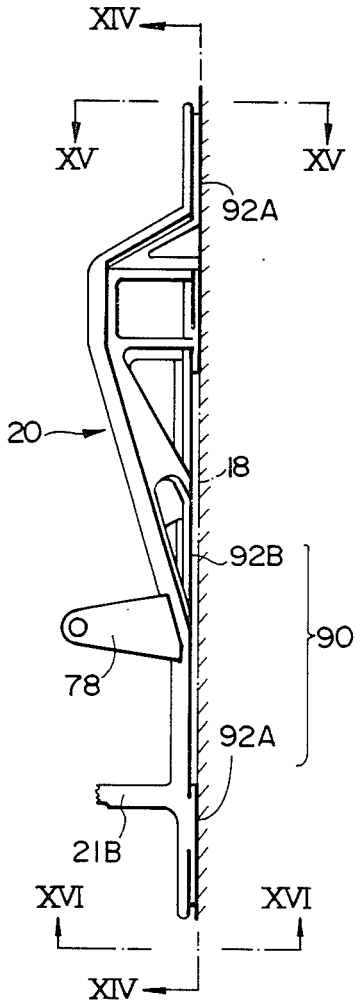
FIG. 13 is a side view showing the mounted state of the body side base in the above embodiment.
Figure 15:
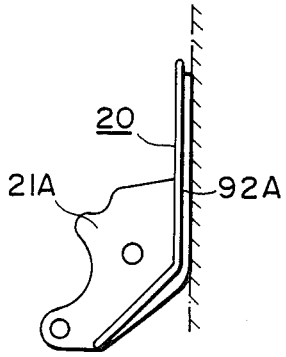
Figure 16:
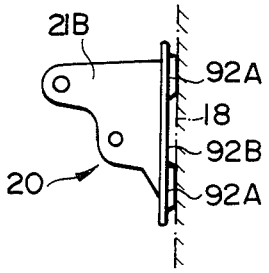

As hatchedly shown in FIG. 11, the mounting surfaces 92A are formed only around the top and bottom bolt holes 20A, 20B, the intermediate bolt hole 20C and the portions interconnecting these bolt holes, and portions other than the above are formed into the float-up surfaces 92B.

Description will hereunder be given of action of the above-described embodiment.

The coaxial degree of the bottom rotary center shafts 22B, 24B, 26B and 28B to the top rotary center shafts 22A, 24A, 26A and 28A are previously adjusted during the manufacturing processes of the door side base 16 and the body side base 20 and during mounting of the top and the bottom rotary center shafts to the door side base 16 and the body side base 20.

In consequence, the side door hinge 10 is mounted to the end panel 14 of the side door 12 and the surface 18A of the front pillar 18 in a state where the top rotary center shafts and the bottom rotary center shafts are aligned with each other in the vertical direction, in the state of the single product as shown in FIG. 1.

When the side door 12 is opened from the fully closed state, the main arm 32 rocks about the top rotary center shaft 28A and the bottom rotary center shaft 28B in the counterclockwise direction in FIG. 3. The top control arm 30A rocks about the top rotary center shaft 26A, and the bottom control arm 30B rocks about the bottom rotary center shaft 26B in the counterclockwise direction in FIG. 3, respectively.

Since the main arm 32, the top control arm 30A and the bottom control arm 30B constitute a quadric roatary link mechanism, the instantaneous rotary center of the side door 12 is progressively changed in position, and slides forwardly, while the side door 12 opens sideways.

At this time, since the rear end portion 11A of the front side fender 11 is located at a position more forwardly than the top rotary center shaft 26A disposed at the foremost position, as opposed to the forward end of the extension 12C of the side door 12, the top and the bottom control arms 30A and 30B can avoid interfering with the rear end portion 11A of the front side fender 11 when the side door 12 is fully opened even if the top and the bottom control arms 30A and 30B are of almost straight-lined shape, being slightly curved.

Further, since the top rotary center shafts 22A, 24A, 26A and 28A and the bottom rotary center shafts 22B, 24B, 26B and 28B are aligned on the inclined axes intersecting downwardly at one point 10A, the side door 12 fully opened has the top end inclined outwardly, so that an occupant can easily get on or off the vehicle.

Figure 17:
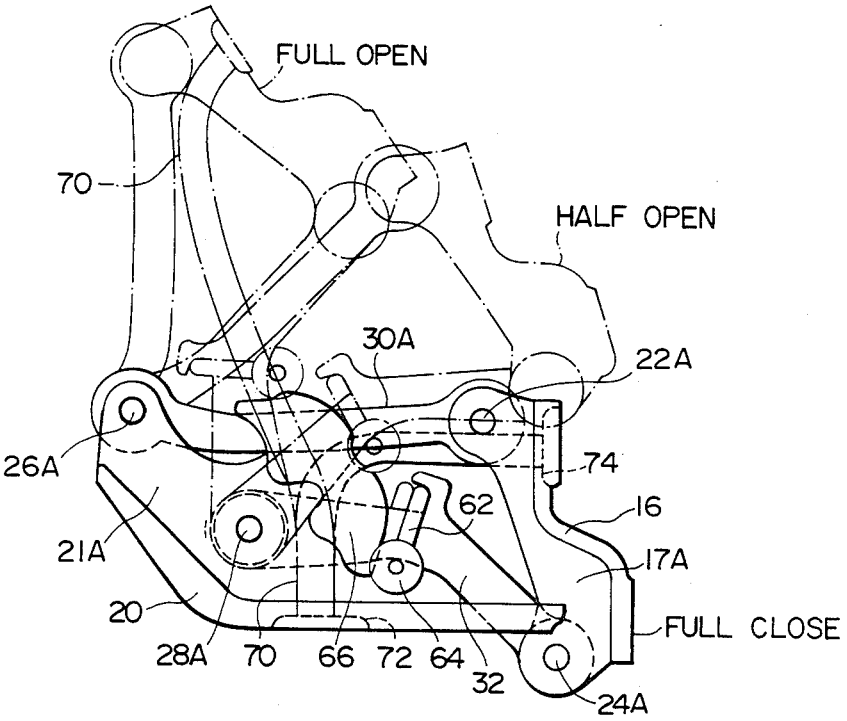
FIG. 17 is a plan view showing the opened and closed states of the side door in the side door hinge in the above embodiment.

As the side door 12 opens or closes, the roller 64 rotatably mounted to the torsion bar 62 in the door check mechanism 60 is brought into rotating contact with the cam surface 66A of the cam plate 66 as the side door 12 rocks (Refer to FIG. 17).

The torsion bar 62 supporting the roller 64 is wound at the wind-in form portion 62A thereof around the torsion bar hook 58. Furthermore, the top end of the torsion bar 62 is formed into the crank-shaped portion 62B, whereby the torsion bar 62 receives a trosional force from the cam surface 66A of the cam plate 66 in accordance with the rocking in the opening direction of the side door 12.

In consequence, as being subjected to a reaction force of the torsional force, the roller 64 is urged against the cam surface 66A of the cam plate 66.

In the cam surface 66A of the cam plate 66, the distance from the top rotary center shaft 28A is suitably varied, whereby the torsional force applied to the torsion bar is varied in accordance with the change in the lift value of the cam surface 66A.

In consequence, the feeling of click motion is produced during the opening or closing operation of the side door 12.

When the side door 12 comes to the fully opened position, the stoppers 52A and 52B which projected from the pipe portion 33 of the main arm 32 abut against the stopper surfaces 54A and 54B of the protrusions 56A and 56B which are provided on the body side base 20, so that the fully opened position can be regulated.

While extending from the end panel 14 of the side door 12 to the surface 18A of the front pillar 18 through the side door hinge 10, the wire harness 70 is disposed in the generally S-shape. Since the wire harness 70 is held by the harness clamp bracket 78 on the side of the body side base 20 through the harness clamp 76 at the position close to the pipe portion 33, the wire harness 70 is rocked about the harness clamp 76 during the opening or closing of the side door 12. Since the main arm 32 is formed into the generally K-shape and the wire harness 70 passes through the V-shape portion where the top arm 38A and the bottom arm 38B intersect each other, the wire harness 70 can avoid being clamped between the main arm 32, the door side base 16 or the body side base 20 during the opening or closing of the side door 12 as shown in FIG. 17.

The wire harness 70 is disposed adjacent the inner side of the pipe portion 33 of the main arm 32. This pipe portion 33 is resiliently coupled at the projections 82A–82C into the harness protector 80 and capable of contacting the wire harness 70 through the harness protector 80, so that the coating on the pipe portion 33 can avoid being peeled off and the wire harness 70 can be prevented from being damaged due to the contact of the wire harness 70 with the pipe portion 33.

In the above-described embodiment, the side door hinge 10 is constructed such that there are provided the four top rotary center shafts 22A, 24A, 26A and 28A, and the four botttom rotary center shafts 22A, 24B, 26B and 28B, which are spaced apart from each other in the vertical direction, these rotary center shafts are supported by one door side base 16 and one body side base 20 which are long in the vertical direction, the main arm 32 mainly supporting the weight of the side door 12 is formed integrally in the vertical direction and the top control arm 30A and the bottom control arm 30B are formed into thin shafts which are provided separetely of the main arm 32, so that the rigidity sufficient for supporting the side door 12 can be obtained without considerably increasing the weight of the side door hinge 10 and the weight of the side door 12, and the works of mounting the side door hinge 10 to the side door 12 and the front pillar 18A and of adjusting the mounting can be made very easy.

The main arm 32 formed integrally in the vertical direction is disposed inwardly of the top control arm 30A and the bottom control arm 30B in the widthwise direction of the vehicle body, whereby the main arm 32 can be disposed at the center of gravity of the side door 12 in the widthwise direction of the vehicle body, so that the load of the side door 12 acting on the side door hinge 10 can be ideally distributed.

From this, the side door hinge 10 itself has no waste in its weight, so that the maximum rigidity can be obtained by the minimum weight.

Particularly, the main arm 32 is intergral in the vertical direction, and more over, provided with the large-diameter pipe portion 33 which is coupled to the top rotary center shaft 28A and the bottom rotary center shaft 28B, so that the rigidity thereof can be increased to a considerable extent without greatly increasing the weight of the main arm 32 as a whole. Here, the pipe portion 33 mainly bears the torsional load, the top arm 38A and the bottom arm 38B, particularly, the top arm 38A bears the load of the side door 12.

The main arm 32 is formed into a generally chevron-shape being convexed outwardly in the widthwise direction of the vehicle body when the side door 12 is fully closed, and provided along the shape of the surface 18A of the front pollar 18 on the outboard side in the widthwise direction of the vehicle body, so that the main arm 32 can be received in the space 34 in the good efficiency of space without interfering the front pillar 18.

On the other hand, the top and the bottom control arms 30A and 30B are of generally straight-lined shape merely bent in a manner to be slightly convexed inwardly in the widthwise direction of the vehicle body. However, since the rear end poriton 11A of the front fender 11 is positioned forwardly of the top rotary center shaft 28A, as opposed to the extension 12C of the side door 12, the side door 12 can slide as forwardly as possible when the side door 12 is fully opened as shown in FIG. 2 with no interference with the rear end portion 11A of the fender 11.

Further, in the state of full closing of the side door, the curves of the top and the bottom control arms 30A and 30B are slight, so that the distance of the space 34 in the widthwise direction of the vehicle body can be made small with no interference of these control arms with the front pillar 18 and the like.

Furthermore, the extension 12C of the side door 12 is formed into the thick width portion 12D expanded inwardly in the direction of the door thickness within the scope of not interfering with the top and the bottom control arms 30A and 30B, so that the extension 12C can be increased in its mechanical strength with high spatial efficiency without sacrificing the size of the side door hinge 10.

In the wire harness 70, the harness hole 72 on the side of the front pillar 18 is offset in the vertical direction relative to the harness hole 74 on the side of the end panel 14 of the side door 12, so that the torsional froce of the wire harness 70, generated during the opening or closing of the side door 12 can be advantageously absorbed by the offset.

The bolt holes 16A and 16B in the door side base 16 and the bolt holes 20A and 20B in the body side base 20 are formed at the top and bottom ends thereof, respectively, and the bearing supporting portions 17A, 17B and 21A, 21B for supporting the rotary center shafts of the quadric rotary link mechanism are formed at positions close to the bolt holes 16A, 16B, 20A and 20B, whereby the side door hinge 10 can be formed as long as possible in the vertical direction, so that the rigidity of the side door hinge 10 can be increased and the load of the side door 12 can be effectively distributed.

The bolt holes and the bearing supporting portions are disposed close to each other, so that the door side base 16 and the body side base 20 can avoid being acted thereon with an excessively concertrated load.

Further, in the surfaces 90 and 92 of the door side base 16 and the body side base 20, which are opposed to the end panel 14 and the front pillar 18, respectively, only the portions around the bolt holes 16A, 16B, 20A, 20B and 20C are made to be the mounting surfaces 90A and 92A which contact the end panel 14 or the surface 18A of the front pillar 18, and portions other than the above are made to be the float-up surfaces 90B and 92B of non-contact, so that, when the motor vehicle enters a coating process with the side door 12 being mounted to the motor vehicle through the door hinge 10, the coating material can easily get into spaces fromed between the surface of the end panel 14 of the side door 12 and the door side base 16 and between the surface 18A of the front pillar 18 and the body side base 20.

When heating in applied to the motor vehicle in a drying furnace, the contact surfaces between the door side base 16 and the end panel 14 and the between the body side base 20 and the front pillar 18 are small in area, whereby heat increase on the end panel 14 and the surface 18A is not hampered so much, so that insufficient drying can be controlled.

In the above-described embodiment, the stoppers 52A and 52B for regulating the fully opened position of the side door 12 are formed at the top and bottom ends of the pipe portion 33 of the main arm 32, i.e. at the positions close to the bolt holes 20A, 20B and 20C of the body side base 20, so that the trends that the stoppers 52A and 52B tend to be deformed relative to the portions where the body side base 20 is mounted to the body can be controlled.

Further, the protruusions 56A and 56B forming the stopper surfaces 54A and 54B which abut against the stoppers 52A and 52B are provided in the corner portions between the inner surface of the body side base 20 and the pair of the top and bottom bearing supporting portions 21A and 21B, so that the impact forces generated by the abutting against the stoppers 52A and 52B can be reliably borne.

The door check mechanism 60 is in the above-described embodiment is constituted by the torsion bar 62, roller 64 and cam plate 66 as described above, whereby no operation failure is caused due to the adhesion of the coating, and the atomosphere of high temperature in the coating drying furnace can be borne as compared with the conventional door check mechanism, so that the side door hinge 10 can be assembled prior to the coating.

The conventional door check mechanism has been mounted to a portion into which sand, mud and the like intrude not easily, whereas, in the above-described embodiment, the door check mechanism is mounted into the space 34 into which water, sand, mud and the like can comparatively easily intrude. The door check mechanism 60 in this embodiment is advantageous in that the door check mechanism is not affected much by the adhesion of water, and or mud.

Particularly, even if sand, dust or the like adheres between the roller 64 and the cam surface 66A which constitute the door checking force, the bite-in of sand, dust or the like does not prevent the rotating contact of the roller 64 with the cam surface 66A, so that the opening-closing operational force of the side door 12 is not increased and troubles do not occur.

In particular, the grease groove 64C is formed on the inner surface of the roller 64 and the heat-resistant grease is filled in the groove, so that smooth rotation of the roller 64 can be maintained and the roller can be passed through the coating drying furnace with the grease being filled therein.

The roller 64 is axially slidably mounted to the crank-shaped portion 62B of the torsion bar 62, whereby assembling errors and manufacturing errors of the the torsion bar hook 58 to which the torsion bar 62 is secured on the side of the main arm 32, the cam plate 66 secured to the bearing supporting portion 21A on the side of the body side base 20 and the torsion bar 62 are absorbed, so that the roller 64 can be brought into contact with the cam surface 66A of the cam plate 66.

Particularly, the roller 64 is provided at the top and bottom thereof with the pair of collars 64A so as to clamp the cam plate 66 from above and below, so that the rotating contact of the roller 64 with the cam surface 66A can be reliably maintained.

The cam plate 66 is the flat plate-shaped member mounted onto the bearing supporting portion 21A perpendicularly intersecting the top rotary center shaft 28A, the cam surface 66A thereof can be readily formed in parallel to the top rotary center shaft 28A, i.e. the rotary center axis of the pipe portion 33 of the main arm 32.

In consequence, during the opening or closing of the side door 12, the roller 64 can slide on the cam surface 66A under a constant condition all the time, whereby the both members are not inclined or twisted with each other.

The pipe portion 33 of the main arm 32 is hollow, so that the rigidity of the main arm 32 can be increased to a considerable extent without greatly increasing the weight threrof. Further, the top rotary center shaft 28A and the bottom rotary center shaft 28B are formed separately of each other and inserted into the coupling holes 33A and 33B which are formed at the top end and the bottom end of the pipe member 33, so that the weight reducing and the assembling properties can be improved as compared with the case where a rotary center shaft formed integrally in the vertical direction is adopted.

In the above-described embodiment, the forward end corner portion of the inner panel 12A of the side door 12 on the side of the compartment 84 is projected forwardly to form the weather strip mount 86, to which the door weather strip is secured, and the rear end face 18C of the front pillar 8 on the side of the vehicle body is opposed to the weather strip mount 86 to form the weather strip abutting surface 18B, which abuts against the door werather strip 88 in the widthwise direction of the vehicle body, so that the space 34 where the side door hinge 10 is disposed can be made small and the rear end face 18C of the front pillar 18 can be shifted more forwardly than the normal case to improve the properties of getting in and out of the vehicle by the occupant.

Further, such a sealing mechanism can be adapted which is suited to the opening or closing locus of the side door 12 in the side door hinge 10 utilizing the quadric rotary link mechanism, so that the sealing during the full closing of the side door 12 can be reliably achieved.

Additionally, in the above-described embodiment, the main arm 32 is formed integrally in the vertical direction and the other arms are formed of the top central arm 30A and the bottom central arm 30B, however, the present invention need not necessarily be limited to this, and the present invention is applicable to the side door hinge mechanism wherein a pair of the quadric roatary link devices each including a first and a second arms are aligned in the vertical direction. In consequence, both the first arm and the second arm may be formed into arms divided into two in the vertical direction, or may be formed integrally in the vertical direction.

However, when one of the arms, i.e. the main arm 32 is formed integrally in the vertical direction as shown in FIG. 1, the door side base 16 and the body side base 20 of the side door hinge 10 in the state of the single product are difficult to make a relative displacement in the vertical direction, so that the coaxial degree therebetween can be advantageously maintained.

Further, in the above embodiment, the main arm 32 disposed inwardly in the widthwise direction of the vehicle body is formed integrally in the vertical direction and the arms disposed outwardly in the widthwise direction of the vehicle body are formed separately of each other, however, the present invention need not necessarily be limited to this, and, the present invention may be applied to the cases where the arms disposed outwardly in the widthwise direction are formed integrally and the inner arm is divided in two in the vertical direction, the both arms formed integrally in the vertical direction, and the both arms disposed inwardly and outwardly are each separated into two in the vertical direction.

Furthremore, the top control arm 30A and the bottom control arm 30B may be formed integrally in the vertical direction.

In short, the present invention is generally applicable to a side door hinge mechanism provided therein with a pair of quadric rotary link devices similar in shape in the vertical direction.

Additionally, in the above-described embodiment, the main arm 32 formed integrally in the vertical direction has been formed into the generally K-shape including the pipe portion 33, the top arm 38A and the bottom arm 38B, however, the present invention need not necessarily be limited to this, and the main arm 32 secures a space for allowing the wire harness 70 to pass there through when formed integrally in the vertical direction and rotatably supported by the top rotary center shafts 24A, 28A and the bottom rotary center shafts 24B, 28B.

In consequence, for example, a pipe portion may be provided which is coupled to the top rotary center shaft 24A and the bottom rotary center shaft 24B and the main arm 32 may be frame-shaped. Furthermore, the top rotary center shafts and the bottom rotary center shafts in the above embodiment are supported by the door side base 16 and the body side base 20, however, the present invention necessarily be limited to this, and the present invention is applicable to the case where some or all of these rotary center shafts are directly supported on the side of the side door 12 or the vehicle body.

Further, when the main arm 32 is formed into a generally K-shape in the embodiment shown in FIG. 1, such advantages may be offered that interference thereof with the wire harness 76 is avoided and the weight thereof is decreased.

In the above-described embodiment, the cam plate 66 in the door check machanism 60 is of the flat plate shape and secured to the top bearing supporting portion 21A of the body side base 20, whereby the cam surface 66A comes to be in parallel to the rotary center axis of the pipe portion 33 of the main arm 32. However, irrespective of the shape of the cam plate 66, the cam surface 66A may be in parallel to the rotary center axis of the pipe portion. In consequence, the cam plate 66 need not necessarily be of the flat plate-shape.

Further, the cam surface 66A may be directly formed by the top bearing supporting portion 21A itself for example.

Figure 18:
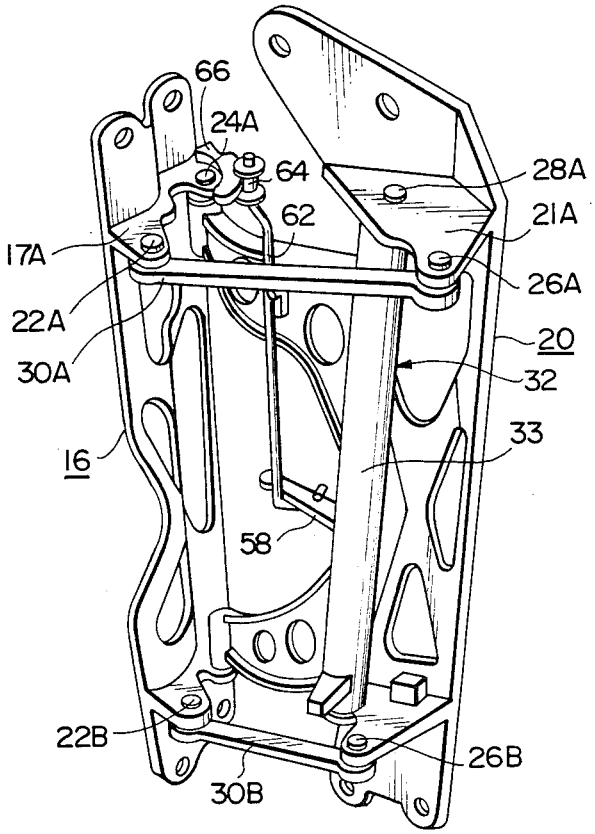
FIGS. 18 and 19 are perspective views showing other embodiments of the door check mechanism according to the present invention.
Figure 19:
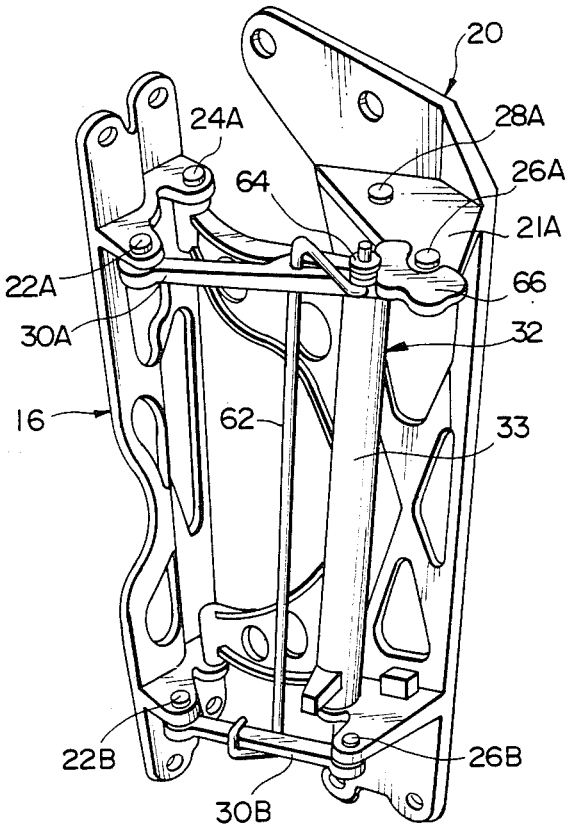

As shown in FIG. 18, the cam plate 66 may be provided on the top bearing supporting portion 17A of the door side base 16. Further, as shown in FIG. 19, the torsion bar 62 may be secured to the top control arm 30A and the bottom control arm 30B, and the cam plate 66 may be secured to the bearing supporting portion 21A, being centered about the top rotary center shaft 26A on the side of the vehicle body.

What is claimed is:

1. A side door hinge mechanism in a motor vehicle having a quadric rotary link device for movably connecting a rocket proximal end of a side door to a side of a vehicle body, said hinge mechanism comprising:

a body side bare formed long in the vertical direction along a surface of a front pillar of the vehicle body, a door side base formed long in the vertical direction along a surface of the rocking proximal end of the side door of said vehicle body, a plurality of top rotary center shafts and a corresponding plurality of bottom rotary center shafts aligned with said top rotary center shafts and positioned downwardly therefrom, said top and bottom rotary center shafts being located in pairs in top and bottom portions of said body side base and said door side base, each rotary center shaft of each pair of rotary center shafts being spaced from each other;

a first control arm connected at one end to one rotary center shaft of one pair of rotary center shafts on the body side base and at an opposite end to one rotary center shaft of one pair of rotary center shafts on the door side base; and a second control arm connected at one end to the other rotary center shaft in said pair of rotary center shafts on said body side base and at an opposite end to the other of said rotry center shafts in said pair of rotary center shafts on the said door side base;

wherein one of said first and said second arms is a top control arm rotatably connected at opposite ends thereof to said top rotary center shafts on one side of said body base and said door side base and a bottom control arm is rotatably connected at opposite ends thereof to said bottom rotary center shafts aligned with said top rotary center shafts at the opposite ends of said top control arm; and the other of said first arm and second arm is a main arm formed integrally in the vertical direction and rotatably connected at opposite ends thereof in the vertical and widthwise directions thereof to said top and bottom rotary center shafts; and wherein said main arm is formed integrally in the vertical direction, rotatably connected at upper opposite ends thereof to the top rotary center shafts disposed inwardly in the widthwise direction of the vehicle body, on the sides of the vehicle body and the side door, respectively, and rotatably supported at lower opposite ends thereof by the bottom rotary center shafts disposed inwardly in the widthwise direction of the vehicle body, which are opposed to said top rotary center shafts, said top control arm is rotatably supported at opposite ends thereof by the remaining top rotary center shafts, and said bottom control arm is rotatably supported at opposite ends thereof by the remaining bottom rotary center shafts;

said hinge mechanism is provided therein with a wire harness extending from said rocking proximal end of the side door to which said door side base is secured to the surface of the vehicle body to which said body side base is secured, said harness passing by the rotary center shafts of said main arm on the side of the vehicle body between the top and bottom rotary center shafts in the vertical direction;

said main arm is formed with a pipe portion supported at top and bottom ends thereof by the top and bottom rotary center shafts on the side of the vehicle body and a space adjacent to the intermediate portion in the vertical direction of said pipe portion for allowing the wire harness to pass therethrough; and a harness protector made of resin is mounted to said pipe portion facing said space.

2. A side door hinge mechanism in a motor vehicle as set forth in claim 1, wherein surfaces of the door side base and body side base opposed to the surfaces of said side door and said vehicle body have float-up surfaces not contacting the surfaces of said side door and said vehicle body, which are portions other than mounted surfaces of the door side base and body side base that are mounted to said door and the vehicle body.

3. A side door hinge mechanism in a motor vehicle as set forth in claim 2, wherein said mounted surfaces are portions close to the circumferences of bolt holes for connecting said door side base and said body side base to the surfaces of the door and the vehicle body.

4. A side door hinge mechanism in a motor vehicle as set forth in claim 1, wherein the wire harness extends from said rocking proximal end of the side door, to which said door side base is secured, to the surface of the vehicle body, to which said body side base is secured, passing through a space in the vertical direction between said top and bottom rotary center shafts, a harness clamp bracket integrally projected between said top and bottom rotary center shafts, and a resin clamp fixing the intermediate portion of said wire harness to said harness clamp bracket.

5. A side door hinge mechanism in a motor vehicle as set forth in claim 1, wherein:

said main arm comprises said pipe portion and top and bottom arms integrally projecting sideways from the top portion and the bottom portion of said pipe portion, said top arm and said bottom arm being of generally triangular shapes tapered toward the forward ends thereof and rotatably supported at the forward ends thereof by the top and bottom rotary center shafts on the side of the door; and said space is formed between the proximal ends of the top arm and the bottom arm, connected to said pipe portion.

6. A side door hinge mechanism in a motor vehicle as set forth in claim 1, wherein said harness protector is a tubular member resiliently flared by a slit longitudinally formed in the axial direction, and said pipe portion is formed thereon with projections coupled to said slit, for locking rotation of said harness protector.

* * * * *